US008060983B2

(12) United States Patent
Bortoluzzi

(10) Patent No.: US 8,060,983 B2
(45) Date of Patent: Nov. 22, 2011

(54) DEVICE FOR CUSHIONING AN OPENING AND CLOSING MOVEMENT OF SLIDING SHUTTERS

(75) Inventor: Guido Bortoluzzi, Belluno (IT)

(73) Assignee: Bortoluzzi Mobili S.r.L., Belluno (IT)

( * ) Notice: Subject to any disclaimer, the term of this patent is extended or adjusted under 35 U.S.C. 154(b) by 520 days.

(21) Appl. No.: 12/237,961

(22) Filed: Sep. 25, 2008

(65) Prior Publication Data

US 2010/0071154 A1 Mar. 25, 2010

(51) Int. Cl.
*E05F 5/06* (2006.01)

(52) U.S. Cl. ..... 16/85; 16/49; 16/64; 16/86 B; 16/82

(58) Field of Classification Search ..... 16/82, 85, 16/86 B, 61, 62, 63, 64, 286, 79, 72, 80; 49/404, 49/407, 386, 451, 454, 455; 312/322, 332.1, 312/333, 334.44, 334.46, 319.1; 292/262, 292/266–270, 277

See application file for complete search history.

(56) References Cited

U.S. PATENT DOCUMENTS

| | | | | | |
|---|---|---|---|---|---|
| 3,630,560 | A * | 12/1971 | Atkins et al. | ..... | 292/270 |
| 4,872,239 | A * | 10/1989 | Ferguson et al. | ..... | 16/64 |
| 6,408,483 | B1 * | 6/2002 | Salice | ..... | 16/85 |
| 6,848,759 | B2 * | 2/2005 | Doornbos et al. | ..... | 312/319.1 |
| 7,240,978 | B2 * | 7/2007 | Kobayashi et al. | ..... | 312/333 |
| 7,866,003 | B2 * | 1/2011 | Tooyama | ..... | 16/422 |
| 2008/0244862 | A1 * | 10/2008 | Tooyama | ..... | 16/82 |
| 2010/0031468 | A1 * | 2/2010 | Tomiji et al. | ..... | 16/52 |

FOREIGN PATENT DOCUMENTS

| | | | |
|---|---|---|---|
| JP | 11159237 | A * | 6/1999 |
| JP | 2006194051 | A * | 7/2006 |
| JP | 2006299578 | A * | 11/2006 |

* cited by examiner

*Primary Examiner* — Chuck Y. Mah

(74) *Attorney, Agent, or Firm* — Kevin J. McNeely; McNeely, Hare & War LLP

(57) ABSTRACT

A cushioning device for opening and closing of sliding shutters, particularly of sliding shutters for furniture, to be applied as a single item to each shutter or sliding partition, in order to be able to cushion an end part of their opening and closing movement. The cushioning device includes a cushioning box applied with brackets for support and sliding of the individual shutter; this box being equipped with two opposing braking devices of a rotary type, whose toothed hub directly meshes with a rack fixed to the box, each braking device being joined to its own slider guided by the box and being joined at one end by an elastic device with its opposite end joined to the other slider, both sliders being equipped with a hook for activating and deactivating the corresponding action of the final section of travel to be cushioned.

16 Claims, 16 Drawing Sheets

DEVICE FOR CUSHIONING AN OPENING AND CLOSING MOVEMENT OF SLIDING SHUTTERS

BACKGROUND

This innovation concerns the design of a device to be applied to one of support brackets of any sliding door or shutter, particularly furniture or sliding partitions, in order to cushion their movement, near a point of arrival at ends of gaps or openings that these shutters open or close.

The use of sliding doors or glass partitions, for example for furniture, display windows, fitted wardrobes or sliding partition walls, is particularly advantageous, compared to hinged systems, due to the fact that it allows for much larger closing and opening surfaces to be designed, without having to provide large spaces in front to allow for opening and closing.

According to a well-known technique, precisely due to their considerable size, any sliding door or glass partition is usually supported by a pair of brackets or carriages fixed at its upper edges. Each carriage has a corresponding sliding wheel, whose race is joined to a track. The track is mounted on the upper surface of the item of furniture or the void to be closed, whilst a striker or a lower guide, essentially parallel to the upper track, typically forces the side opposite the shutter itself to always remain in a vertical position, even when sliding, using countless structural solutions proposed and illustrated, for example, by EP 0 001 956 dated 1978 or by U.S. Pat. No. 5,247,763 dated 1990 or by EP 0 567 262 dated 1992.

This same well-known technique in fact, usually requires a pair of voids placed side by side to be closed by a pair of shutters; these, sliding on corresponding parallel tracks and guides placed side by side, allow one of the two voids to be fully opened, overlapping the opened shutter onto the shutter of the closed void, whilst, when both shutters are closing the corresponding voids, they are in any case mounted on two parallel levels, with the edge of one of their central sides ideally aligned or, more often, slightly overlapping the edge of the other shutter.

All these well-known solutions typically provide for that the void can be closed and opened by pushing or drawing the shutter along its track, with a physical force proportional to the size and therefore the weight of the shutter itself.

In order to prevent an excessive force pushing the shutter hard against the opening or closing doorstop, the same well-known technique envisages the application of "stoppers" or catches with narrow seat or section, within which a latch can be slotted for the travelling shutter that, due to friction, can slow down its drive, before reaching its doorstop.

This method, however, has been shown to be rather ineffective, both due to wear over time and, especially, when the shutter is pushed or drawn with excessive force, given that the narrow section of the catch does not manage to retain the shutter latch, which rides over said "stopper", bouncing against the doorstop and, tending to travel back, partly obstructing the void to be opened, with subsequent manual adjustments to the position of the shutter itself, as well as frequent damage due to vibration from parts being struck.

A more recent technique aims to overcome this disadvantage, cushioning the end part of the shutter travel, when it is near full opening or closing, exploiting the absorption capacity of an elastic compression device, which is put into contact with the edge of the travelling shutter, in order to then use its reaction force to be discharged gradually into the chamber of a special piston connected to it, for example a pneumatic one, as proposed by Patents EP 1 348 828 and EP 1 426 535 for each of the two sides of the shutter itself.

Nevertheless, each known cushioning solution, among those mentioned above, has highlighted problems and disadvantages that limit their effectiveness and reduce their use to a few simple cases of furniture or sliding partitions that are not subject to heavy use.

A first disadvantage is the fact that, as is well-known, pistons have a life limited by the fastness to hold their seal, therefore requiring a foreseeable scheduled maintenance programme that does not seem to be justified, for example for furniture doors.

A second disadvantage of linking elastic devices and pistons is that, with uncalibrated collisions and thrusting, the piston tends to deform and in any case deteriorate even more often than expected, impacting further on the limited life of the item of furniture or shutter to be closed and opened.

Another disadvantage of this recent technique is the fact that, as it is well-known, a normal traction spring does not absorb and transmit a thrust uniformly, but proportionally to its expansion or extension, with a consequent increase in the force required to push the shutter at different gap opening or closing positions.

Finally, all the well-known forms of cushioning with springs and pistons, as above, at most allow the application of only two shutters, given that the devices are applied directly onto the track, thus preventing the translation of the cushioning devices of a possible third sliding shutter.

SUMMARY

The main task of this innovation is in fact being able to construct a single device for the final cushioning of the travel when opening and closing the sliding shutters, on items of furniture for example, without having to apply one per bracket or in any case one for the opening side and one for the closing side of the same shutter.

In this task, another aim of the innovation is always being able to balance the action of the braking device with the reaction of an adequate elastic device, in order to regulate the final travel of the shutter, independently of its mass and of the variability of the force of the thrust or traction required, as well as of the maximum extension of the elastic device, albeit without having to resort to cumbersome block systems to limit the travel.

Another aim of this innovation is to be able to construct a cushioning device that is adjustable, adaptable and interchangeable for each type of sliding shutter.

Another aim of this innovation is to ensure, over time, the efficiency and constancy of operation of the device for the automatic attenuation of the thrust or drawing force, avoiding the damage currently caused each time a shutter collides with its doorstop.

Another important aim of this innovation is that it does not require scheduled or frequent maintenance, due to wearing of the seals of the current pistons, as well as their fragility against blows or collisions due to undue thrusting.

A further aim of this innovation is to be able to place this cushioning device onto items of furniture or voids with three or more shutters, without creating obstructions that inhibit the corresponding proper opening and closing operation.

These and other aims are achieved with a cushioning device according to features of claim 1.

A cushioning device for opening and closing of sliding shutters, particularly of sliding shutters for furniture, to be applied as a single item to each shutter or sliding partition, in order to be able to cushion an end part of their opening and closing movement, is characterised by the fact that it is essentially made up of a cushioning box, to be applied with its own brackets or even on brackets for the support and sliding of the individual shutter; this box being equipped with two opposing braking devices, of a well-known viscous fluid rotary type, whose toothed hub directly meshes with a rack fixed to the box itself; each braking device being joined to its own slider guided by the box itself and being joined at one end by an elastic device with its opposite end joined to the other slider, both sliders being equipped with a hook for activating and deactivating the corresponding action of the final section of travel to be cushioned.

Especially, such a device is characterised by the fact that a cushioning box is made up of a structured box base, with a longitudinal lower slit, on the lower side and with one of its flanks closed by an edge or guiding wall of a cover, said lower slit being capable of connecting the internal cushioning part of the box with the external activation part, for hooking and unhooking, vis-à-vis some strikers mounted near tracks for translation of one or more of the shutters. The structured box or base may have a longitudinal void capable of containing and guiding the longitudinal translation of a pair of sliders in cooperation with the cover that delimits said longitudinal void of the base. Each slider can have the braking device of a viscous fluid rotary type, whose toothed pinions directly mesh with teeth of a rack joined longitudinally to the box. In such device the rack may be integral to the cover.

In such device the sliders can be joined together by the elastic device working by traction, used to bring the same sliders closer together, overcoming the braking force of their devices. The elastic device is made up of a double helical traction spring, made out of a particularly elastic material, one of the springs being equipped with head hooks or eyelets and the other spring being a internal and coaxial spring and being equipped with head hooks or eyelets that can hook onto the two sliders.

The lower slit of the box structure can have a pair of lateral slots and/or housings mounted near its two ends.

The cover may have a small side wall or edge being a little shorter than the length of the lower slit of the box base.

Especially, the sliders are linked to their corresponding hooks, which are external to the box and can activate a traction action of the elastic device as well as the braking action of the braking devices, due to the contact of these hooks with strikers mounted in a suitable position, near tracks for the sliding and translation of the shutters.

Following the external or manual opening or closing of such a shutter, the hooks can be housed in their corresponding slots or housings of the lower slit, remaining engaged there until a new contact with the same strikers, acting on their contact housings makes them rotate on the hinge, releasing them from their slot or housing, together with their corresponding sliders, causing the desired cushioning, with the traction reaction of the elastic device and the braking element of the braking devices.

Following the external or manual opening or closing of a shutter, crooks of the hooks can hook onto the ends of a/the small side wall of the cover, and can remain engaged there until a new contact with the same strikers, acting on their contact housings makes them rotate on their hinge, releasing said crooks at the ends of the small side wall, together with their corresponding slider, causing the desired cushioning, with the traction reaction of the elastic device and the braking element of the corresponding devices.

A safety hook may be joined to the hook, just as a safety hook is joined to other hook, which safety hooks are equipped with a hooked wall adjoining an inclined wall that can hook the strikers in an initial stage of the application of the device or in subsequent ones when it is newly applied to the sliding shutters.

The cushioning box can be applied in any position of the upper side of shutter, as well as inverted, compared to the solution mentioned, consequently adjusting the position of the strikers.

These and other aims are in effect fully achieved with especially a device, which prescribes the design of a single box for cushioning the final movement of the shutter, where the box is used for both the opening and closing phases, and where the box could be applied for example to one of the support and longitudinal sliding brackets of the shutter itself; this box having two opposing braking devices, especially of the well-known viscous fluid rotary type, whose corresponding toothed hub directly meshes with a toothing (or teeth) of a longitudinal rack integral to this box; each braking device being joined to its own slider, which is longitudinally guided by the box itself and is joined to its corresponding elastic device working by traction and with the opposite end joined to the other slider; finally this slider having a hook that activates and deactivates a corresponding cushioning section, due to its contact with corresponding strikers; these strikers being fixed to the roof of a void, near the guide rail and are mounted near shutter's full opening and closing points on the opening to be closed.

Especially, the main feature of this innovation is the design of a single box for cushioning a final movement of the shutter, so that it can be used when both opening and closing the same shutter; this box could be applied for example to one of the support and longitudinal sliding brackets of this shutter, or to two independent fixing brackets on the upper side of the shutter. This box has two opposing braking devices, of well-known viscous fluid rotary type, whose corresponding toothed hub directly meshes with a toothing of a single longitudinal rack integral to the box itself; each braking device is joined to its own slider which is guided longitudinally by the box itself and is joined to its corresponding elastic device with the opposite end joined to the other slider; each slider also has a hook for activating and deactivating the corresponding cushioning section, due to its contact with fixed pins arranged near the shutter's full opening and closing points on the gap being closed.

DESCRIPTION OF THE DRAWINGS

A better understanding of the solution proposed and an underlining of the achievement of the aims indicated are described in more detail below and also illustrated, according to a purely indicative and non-restrictive structural form, with the aid of drawings, of which.

All the figures are understood to show the same details with the same reference numbers.

DETAILED DESCRIPTION

Figure 1:
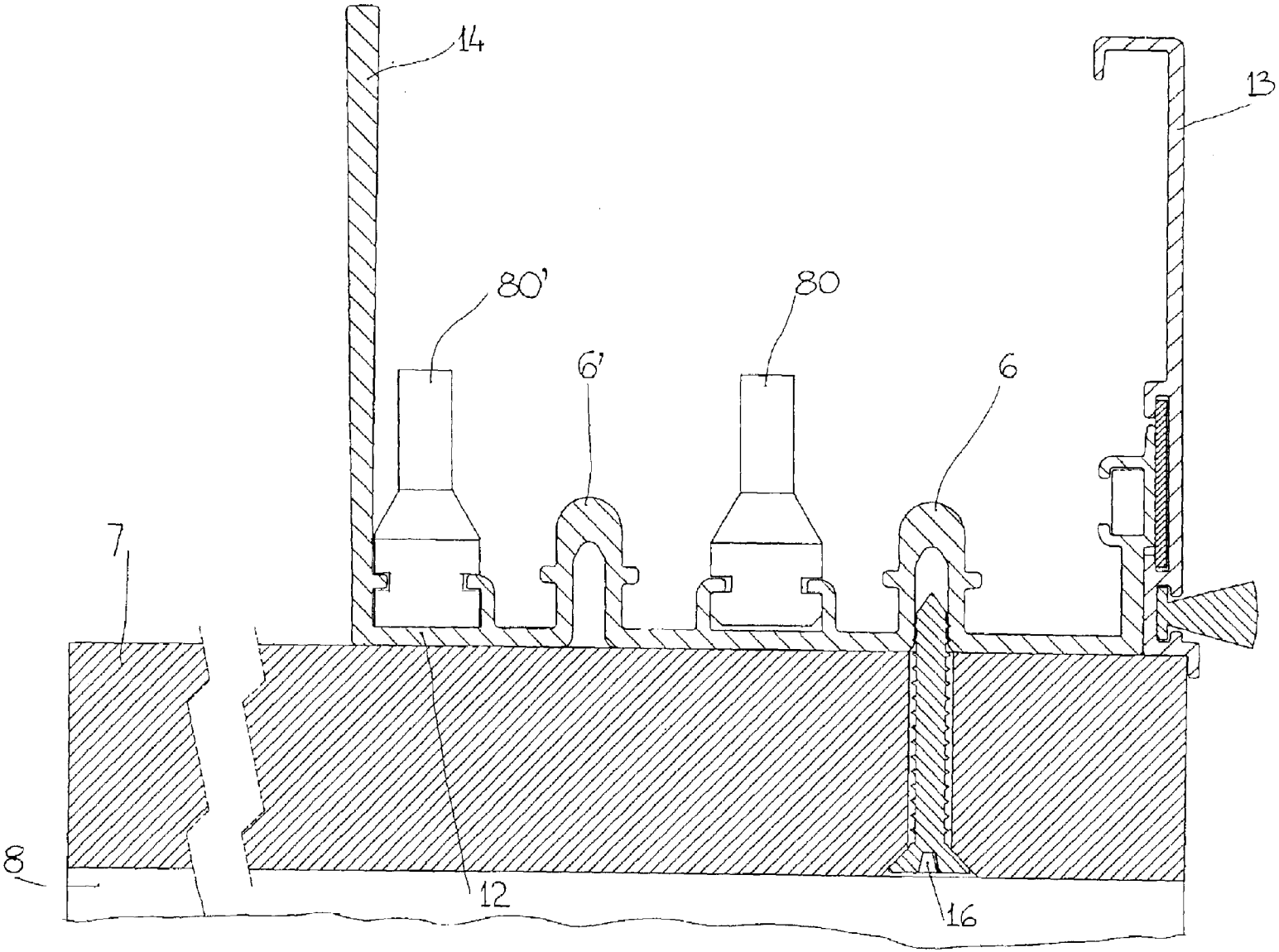
FIG. 1 shows a vertical and cross-sectional view of the upper surface of an item of furniture, on which a section bar is applied with a pair of tracks and the relevant attachments to support the sliding wheels and support brackets for two or more sliding shutters, to which the device in question, for the closing and opening of as many cavities of said item of furniture, should be applied.
Figure 2:
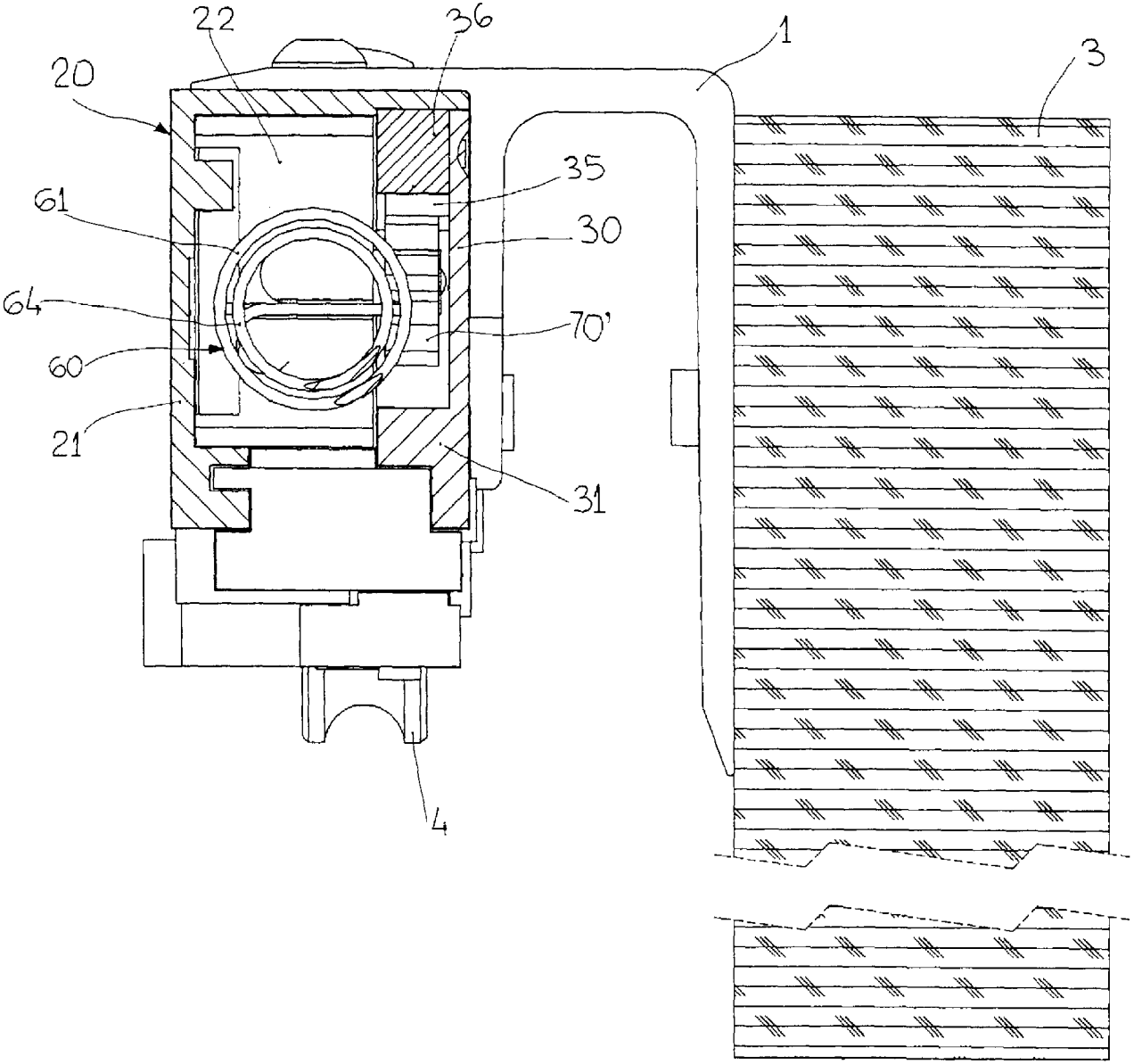
FIG. 2 shows a vertical and cross-sectional view of an upper part of a sliding shutter for the item of furniture in FIG. 1, complete with a support bracket for the sliding wheel and the improved device in question, for cushioning the final opening and closing movement of the shutter itself.
Figure 3:
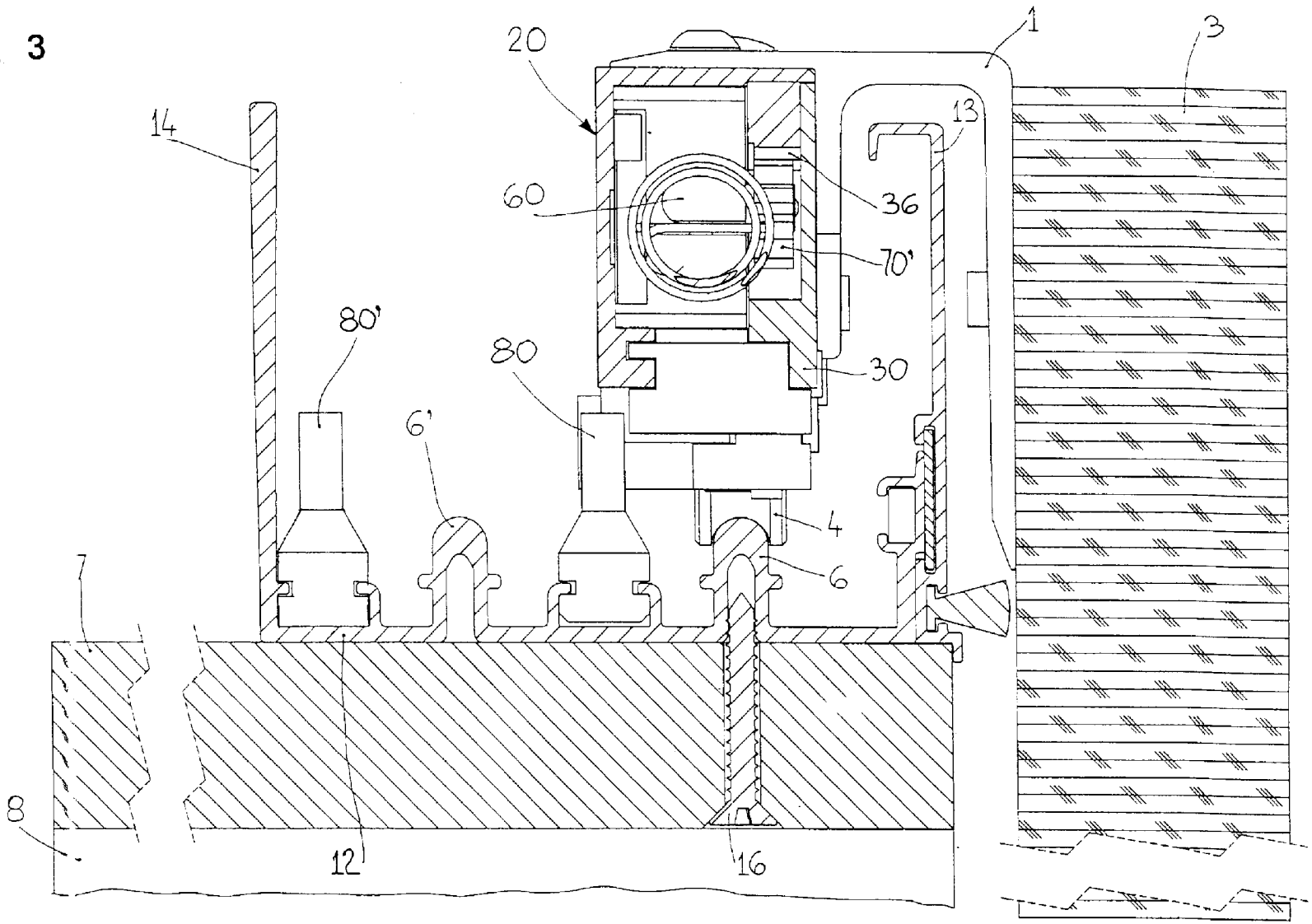
FIG. 3 shows a vertical and cross-sectional view of the upper surface of an item of furniture and the upper part of one of its sliding shutters, as per FIGS. 1 and 2, given that the bracket, sliding wheel and shutter cushioning device are already applied to one of the tracks of the upper surface of the item of furniture.
Figure 4:
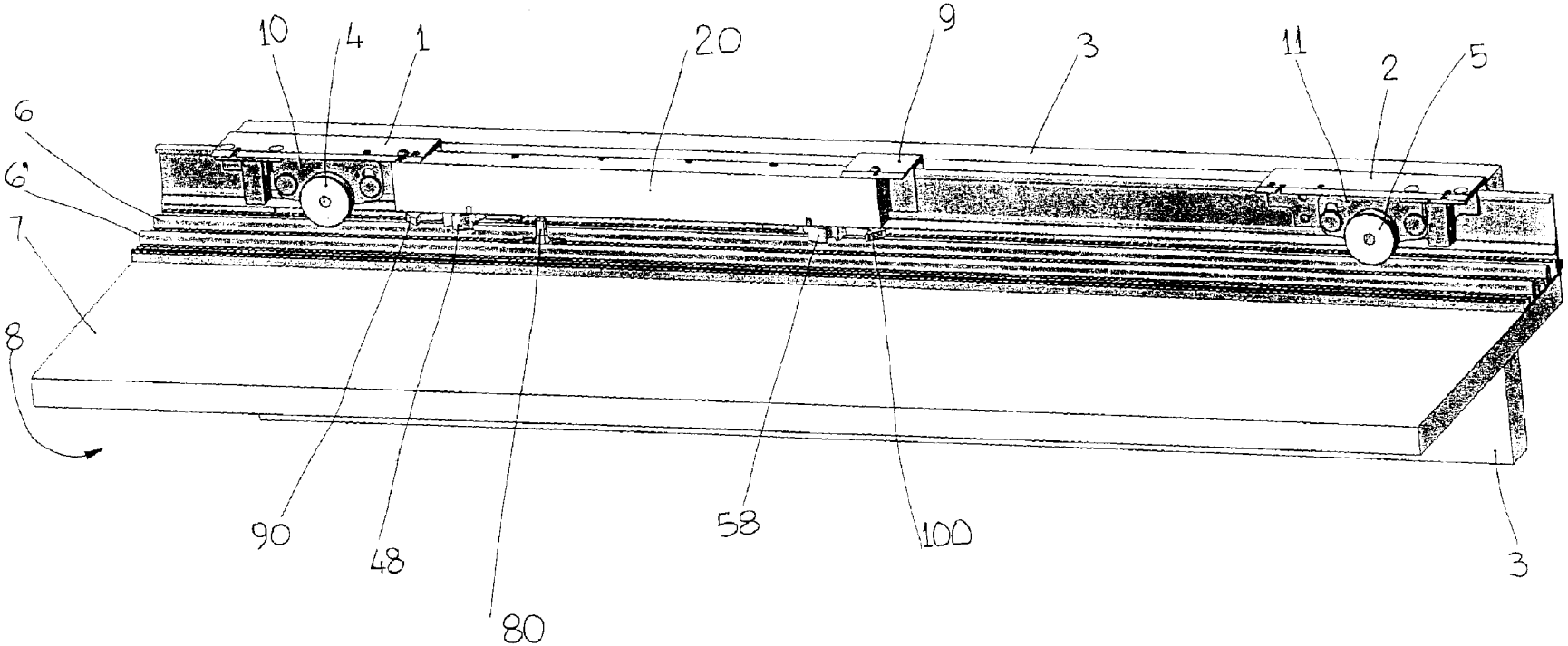
FIG. 4 shows a perspective view, from above the upper surface of an item of furniture, of a part of the upper surface and one of the upper parts of a shutter and the relevant brackets with sliding and support wheels, plus the application of the cushioning device of the shutter itself to one of said brackets, according to the assembly shown in FIG. 3.

According to the structural solution shown for illustration purposes in the various figures, an improved device for cushioning the opening and closing movement of sliding shutters, is essentially made up of a cushioning box 20, to be applied to one of brackets 1 or 2 that are fixed to an upper edge of a sliding shutter 3, whose smoothness is ensured by corresponding idler sliding wheels 4 and 5 running along a same track 6, which is integral to a base plate 12 being mounted on an upper surface 7 of a void 8 that should be able to be opened or closed with said shutter 3, as schematically shown in FIGS. 3 and 4.

Again in accordance with the solution illustrated, the same FIGS. 3-4 show that this cushioning box 20, as well as being integral from one end of the bracket 1 is also fixed to the edge of the sliding shutter 3 by a second bracket 9, whilst at the upper surface 7 a second track 6' is also applied, integral to the base plate 12, for the cushioned movement of other sliding doors.

According to a traditional technique, the sliding wheels 4 and 5 are fixed to the corresponding brackets 1 and 2, respectively, by the interposition of each a corresponding plate 10 and 11, respectively, for adjusting the height and verticality of each shutter 3, whilst the base plate 12, from which the tracks 6 and 6' emerge and which is fixed to the upper surface 7, for example by means of screws 16, has a convenient auxiliary wall 13, that hides the tracks 6 and 6' from view, and an auxiliary wall 14 that acts as a rib to strengthen the base 12.

Naturally the support brackets 1-2 and the regulation plates 10, 11 on the sliding wheels 4, 5 can be designed in various forms, including those already on the market, whilst not being innovations of the present solution which is instead given by the box 20 and by its attachments described below. This box 20 is able to act on both sides of the shutter 3, cushioning a final travel section, when the void is both opened and closed 8.

Figure 5:
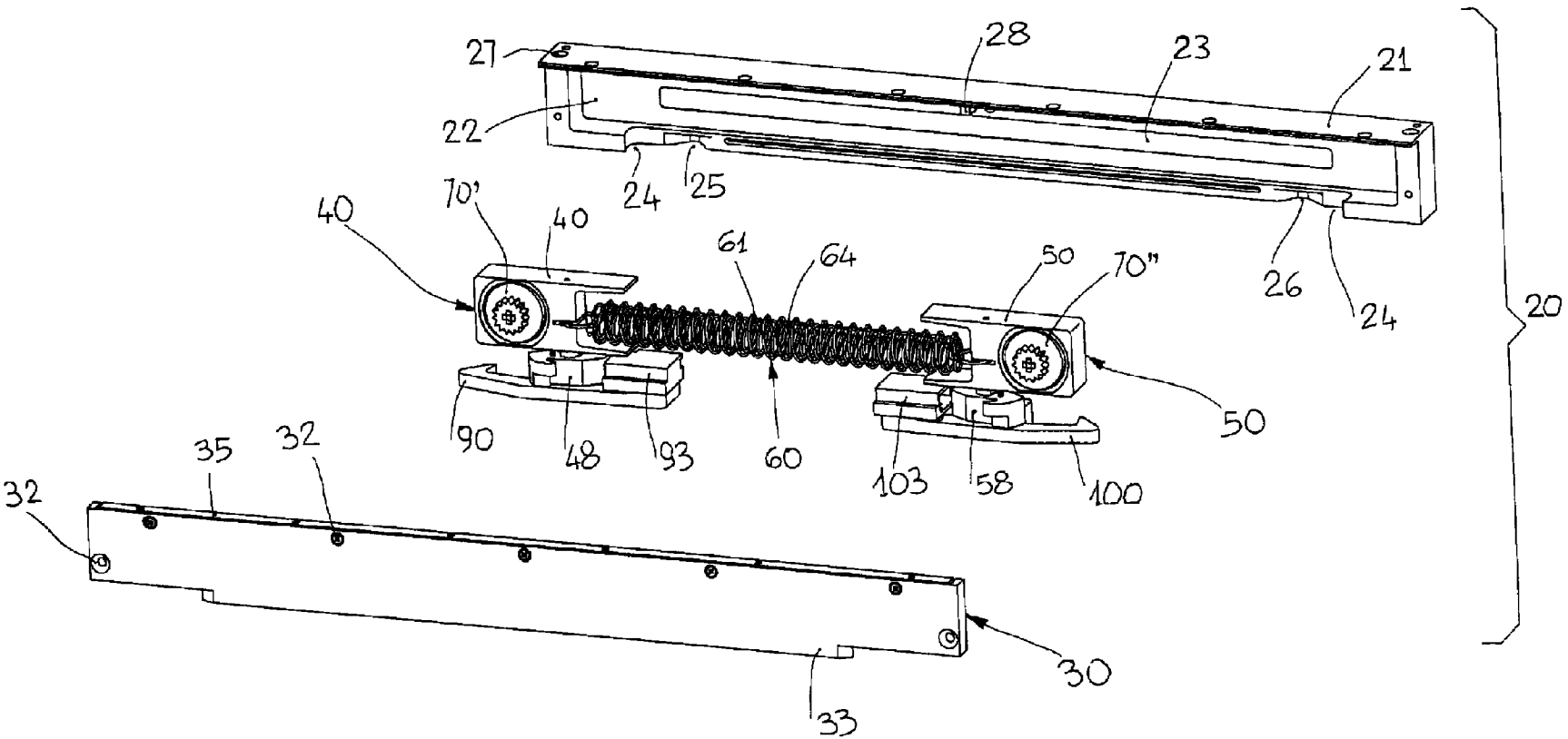
FIG. 5 shows a perspective and exploded view of the container box, with the cover and the other parts making up the cushioning device in question, already shown in FIG. 4.

With reference to FIG. 5, the cushioning box 20 is made up of a box shaped-base (structured box base) 21 and a cover 30, which enclose and guide a pair of opposing sliders 40 and 50, joined together by an elastic traction device 60. Each of these sliders 40, 50 has its own viscous fluid rotary braking device 70', 70" acting against the traction of said elastic device 60.

In closer detail, the box shaped-base 21 has a special internal void 22 with a longitudinal open lightening slit 23 and a lower open slit 24 with a pair of recessed lateral slots 25 and 26. The longitudinal open lightening slit 23 is arranged in a lateral wall of the box 20. The lower open slit 24 is arranged in a bottom wall of the box 20. The pair of recessed lateral slots 25, 26 may lead from the lower open slit 24 or beneath of it into the base 21 of the box 20.

There is at least one striker 28 situated in the centre of the longitudinal void 22 of the box 20, integral with the structured box base 21, to limit the travel of the opposing sliders 40 and 50 in a direction one to the other.

The aforementioned lower open slit 24 of the box 20 is closed on one side by the overlapping cover 30 and its guiding wall 31, by a fixing, for example self-tapping screws passing through slots 32 or openings leading through the wall 31.

Figure 6:
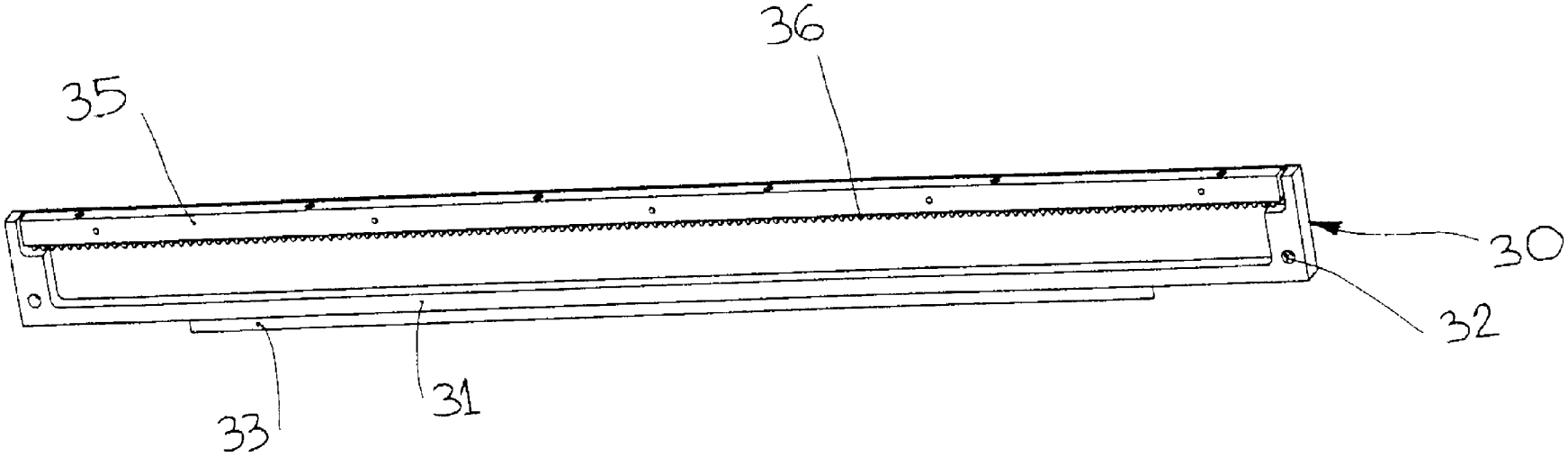
FIG. 6 shows a perspective view of the same cover to be joined to the box in FIG. 5, the cover being shown in an overturned position.

This cover 30 also has a small lateral side wall 33 being a little shorter than the length of the lower open slit 24, whilst on its opposite side it has a bar or longitudinal edge 35 on the internal side of which is a toothing of a rack 36. Especially, as can be seen from FIG. 6 in mounted position the small lateral side wall 33 extends downwardly from the guiding wall 31, whilst on its opposite upper side it has the bar or longitudinal edge 35. FIG. 6 highlights the fact that the internal side of the cover 30 has a bar 35, fixed to the same cover, for example with screws, with a toothed lower edge of the rack 36.

Figure 7:
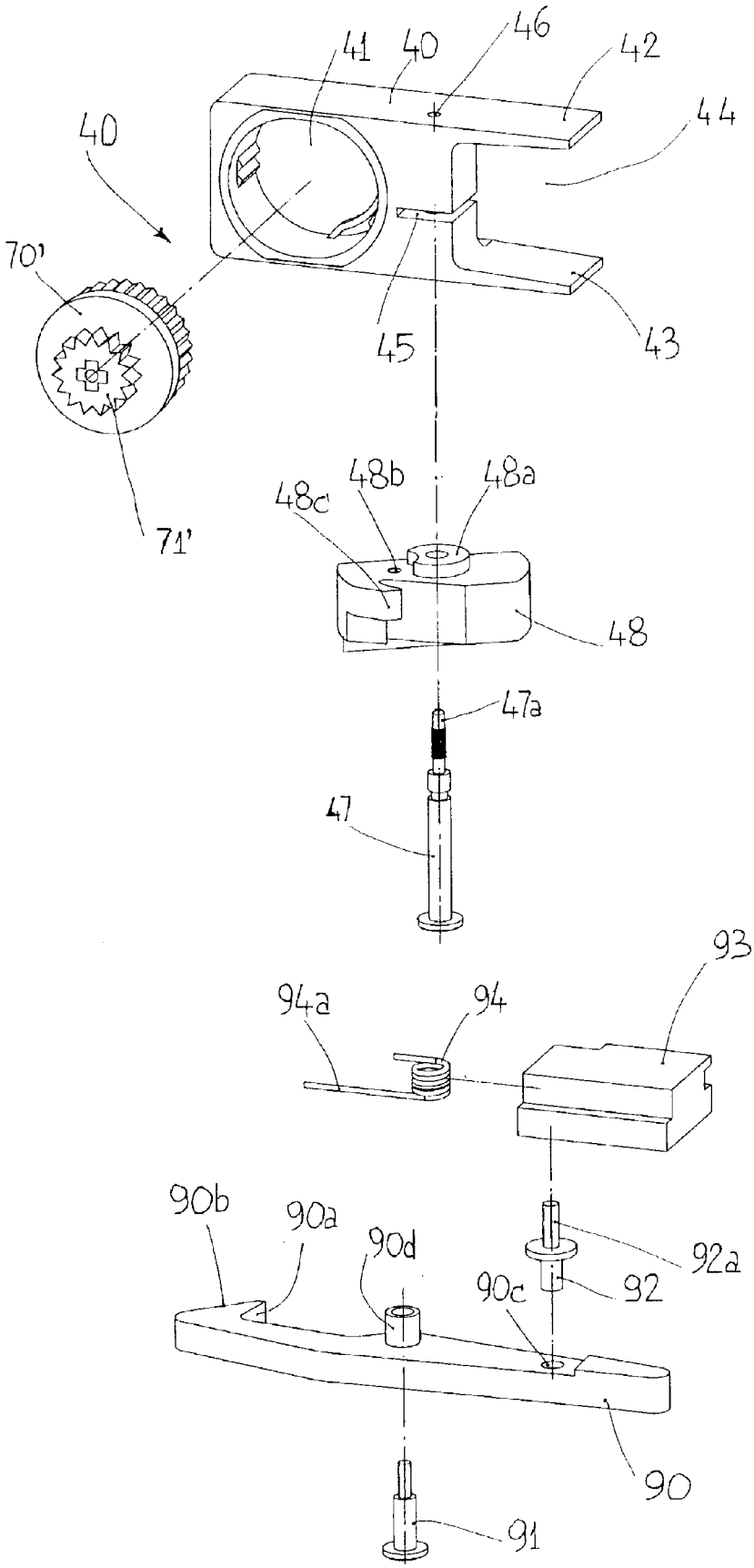
FIG. 7 shows a perspective view of the slider and its hook for activating the cushioning phase, to be placed on the left-hand side of the bottom of the box in FIG. 4, as shown assembled in FIG. 5.

As already specified, in a seat formed by the void 22 of the box 20 there are a pair of the freely sliding sliders 40 and 50 that have their corresponding viscous fluid braking devices 70' and 70", joined together by the elastic device 60, and that have their corresponding devices for hooking and unhooking the cushioning action. These sliders 40, 50 and their components have been jointly shown as 40, 50. In closer detail, as shown in FIG. 7, the slider 40 has an oblong housing 41 containing the viscous fluid braking device 70' with its toothed pinion 71'.

The same slider 40 also has a pair of prongs 42, 43 shaped to form a void 44, linked to a transverse slit 45, and this is completed by the presence of a through hole 46, with its end near the prong 42, which may be of a narrower diameter than its initial part. Especially, the pair of prongs 42, 43 is shaped like a "C" having the transverse slit 45 leading from middle of vertical wall of "C" horizontally into the wall in direction to the oblong housing 41. The through hole 46 leads in an vertical direction and through the transverse slit 45.

Figure 8:
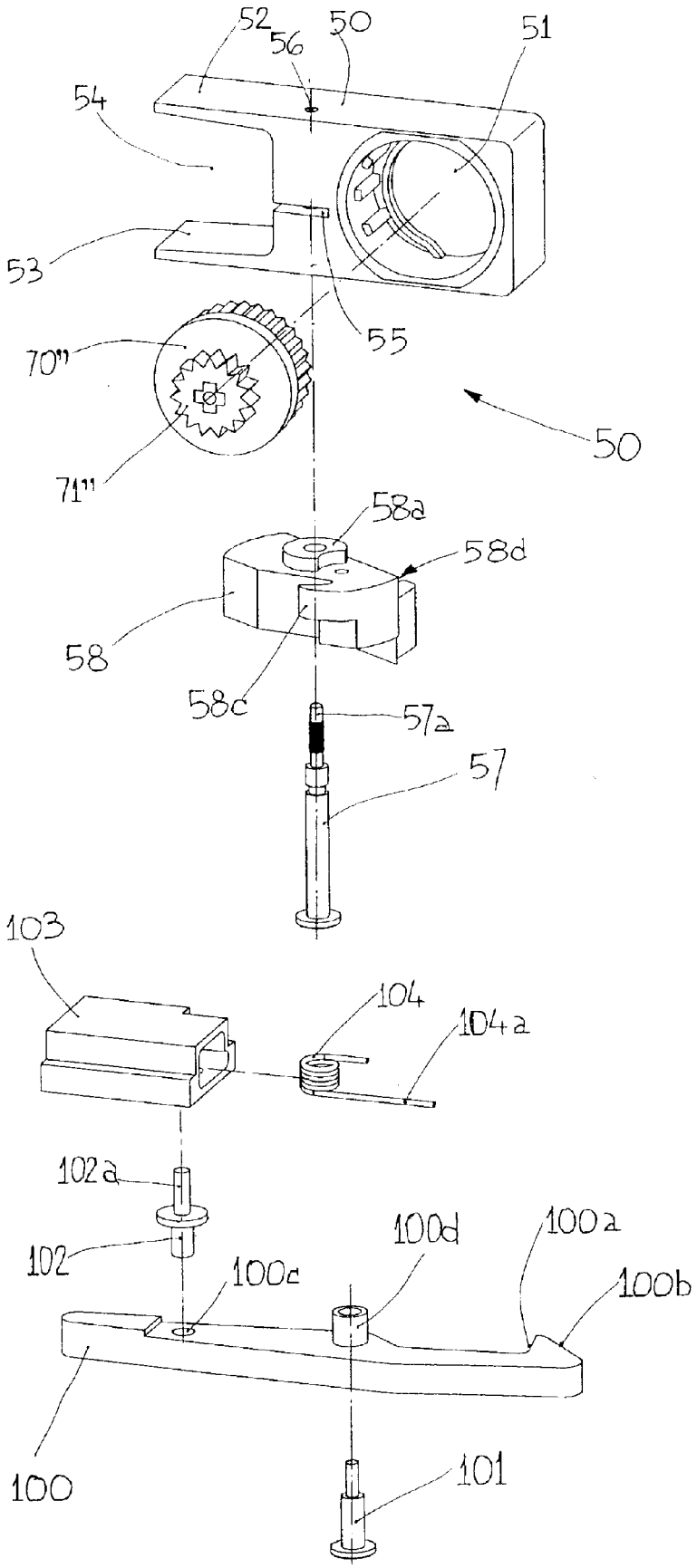
FIG. 8 shows a perspective view of the slider and its hook for activating the cushioning phase, to be placed on the right-hand side of the bottom of the box in FIG. 4, as shown assembled in FIG. 5.

Similarly, as illustrated in FIG. 8, even the slider 50 has an oblong void 51 containing the viscous fluid braking device 70' with its toothed pinion 71", and also has a pair of prongs 52, 53 shaped to form a void 54, linked to a transverse slit 55 and completed by the presence of a through hole 56, with its end near the prong 52 that is of a narrower diameter than its initial part.

The through holes 46, 56 of the slider 40 and of the slider 50, respectively, are housed ends 47*a* and 57*a* of hinges 47 and 57, respectively, under pressure, which join corresponding hooks 48 and 58 to the same sliders 40 and 50, respectively.

Figure 10:
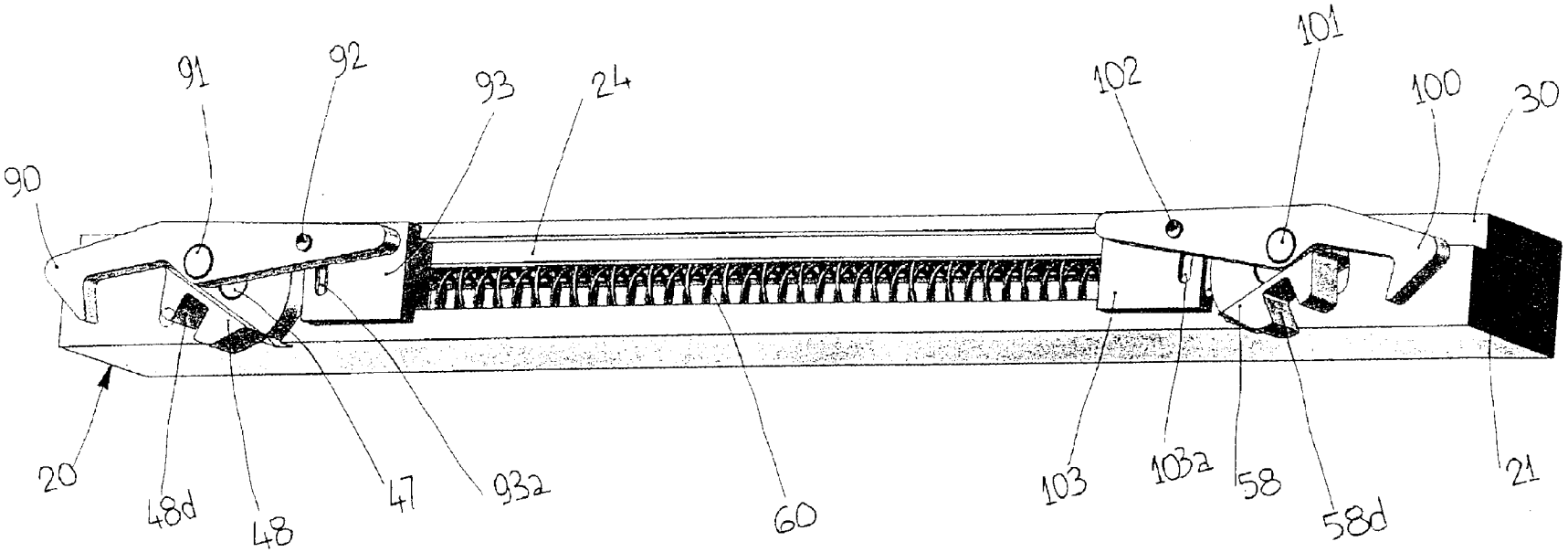
FIG. 10 shows a view, from below, of the box in FIGS. 4 and 5, joined to the parts hooking onto the fixed points activating the cushioning device in question, shown for illustration purposes with the activation hooks at the maximum distance apart.

Given that said sliders 40 and 50 are mounted in the void 22 of the box 20, whilst the hooks 48 and 58 must be external in order to encounter striker pins 80, which control their operation, a collar 48*a*, 58*a* is joined to the same hooks 48, 58, acting as a spacer, vis-à-vis the corresponding sliders 40, 50 and as a guide along the lower open slit 24 of the box 20. The hooks 48, 58 are roughly cylindrical, with an axial perforated collar 48*a*, 58*a* and a parallel through hole 48*b*, 58*b*, as well as a crook 48*c*, 58*c* opposite a housing 48*d*, 58*d* of a fork, as shown in FIGS. 7, 8 and 10.

A safety precaution, for the operation of the hooks 48, 58 is again illustrated in FIGS. 7, 8 and 10, but will be specified in more detail below.

Figure 9:
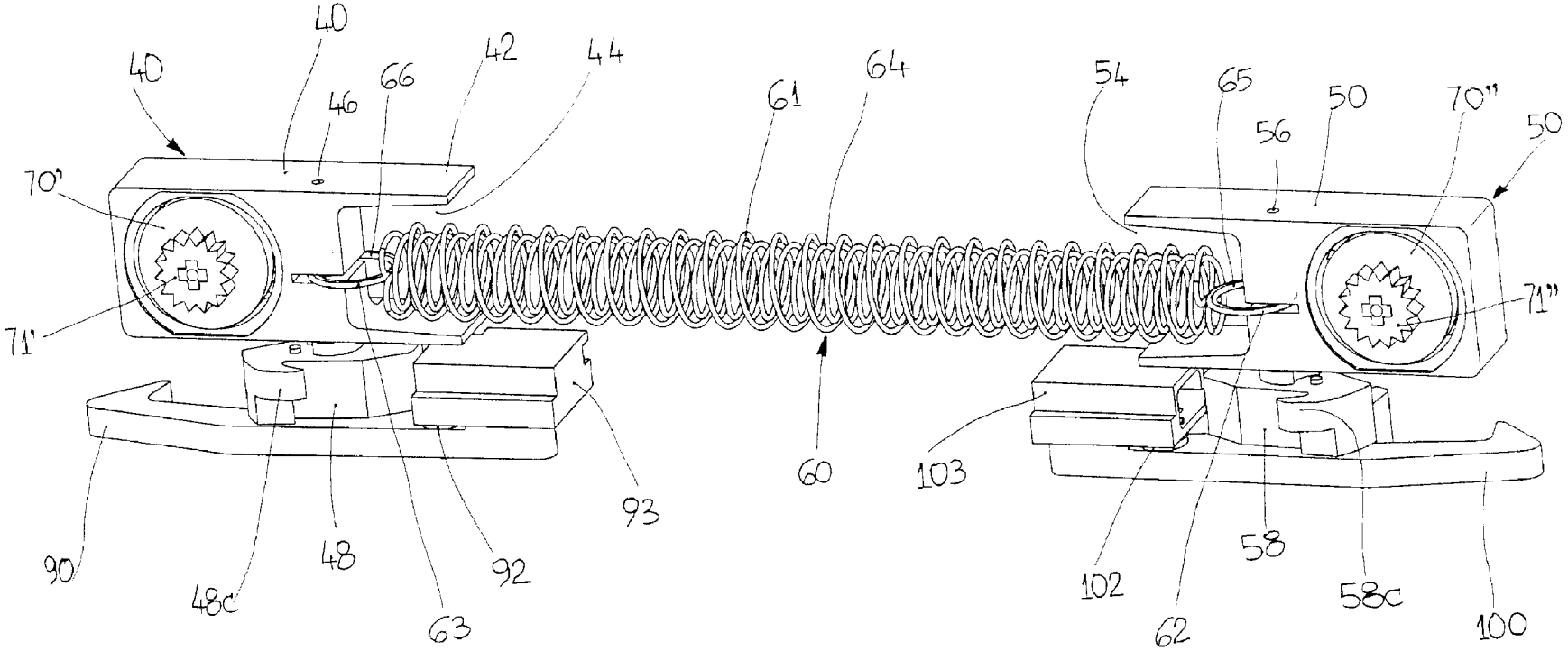
FIG. 9 shows a perspective view of the two left and right sliders, as per FIGS. 7 and 8, as well as their activation hooks, shown pulling apart the double elastic device that joins them.

As already mentioned, cavities formed by the voids 44 and 54 of the sliders 40 and 50, respectively, are used to house the ends of the elastic traction device 60 that joins the same two sliders 40 and 50 counteracting the braking action of the two braking devices 70' and 70", as detailed in FIGS. 5 and 9, which show that said elastic device 60 is innovatively made up of a double concentric helical spring 61, 64, made out of particularly elastic material, so that, when tensioned, the effort required is not excessively variable, because it is the sum of two reactions that are weak or in any case do not exceed the braking action of the devices 70' and 70".

In particular, the external spring 61 has eyelet shaped ends 62 and 63, just as the internal spring 64 has eyelet shaped ends 65 and 66. The second eyelet 65 of the internal spring 64 may be internal to and concentric with the first eyelet 62 of the external spring 61, whilst first eyelet 66 of the internal spring 64 is internal to and concentric with second eyelet 63 of the external spring 61 or vice versa. After housing the one pair of spring eyelets 63, 66 in the slit 45 of the slider 40 and by housing the other pair of spring eyelets 62, 65 of the traction springs 61, 64 in the slit 55 of the other slider 50, the hinges 47 and 57 can then be inserted in the holes 46 and 56 to fix the eyelets 62, 63, 65, 66 in the corresponding slits 45, 55. The hinges 47 and 57 are inserted into the holes 46 and 56 after having inserted the hooks 48 and 58 from the especially lower outside of the box 20, in order to achieve the elasticised union of the same sliders 40 and 50, allowing their minimum and maximum traction, inside the void 22 of the box 20, as highlighted in FIGS. 5 and 9. Thus, the hooks 48 and 58 are turnable in a plane perpendicular to the hinges 47 and 57.

Naturally, before joining the two sliders 40 and 50 with the elastic device 60, the braking device 70' is placed in its housing 41 of the one of the sliders 40, and the other braking device 70" is housed in the void or oblong housing 51 of the other slider 50.

The cover 30 placed on to the box shaped-base 21, already equipped with its sliders 40 and 50 and with the other parts described up to now, allows the meshing of the toothing of the hubs formed as toothed pinions 71' and 71" of the braking devices 70' and 70" with the toothing of the rack 36 of the especially laterally extending bar or edge 35.

By acting on the hook 48, for example, it is possible to draw the slider 40 towards the left-hand edge of the housing 22, unblocking the mesh of the toothed pinion 71' from the rack 36 and also drawing the slider 50 until it strikes against the striker 28, without substantially stressing the elastic device 60. By continuing the manual drawing of the slider 40, it can be taken up to the left-hand lateral edge of the box 20, overcoming the force of the traction springs 61, 64, which, with the cessation of the drawing effort, react and tend to bring the slider 40 itself towards the centre of the housing 22, encountering the resistance of the braking device 70' which thus cushions the reaction of the elastic device 60. Similarly the elastic device 60 is cushioned by acting on the slider 50 after having drawn it towards the right-hand edge of the void 22 itself.

The box 20, essentially assembled with the components described up to now, is attached to the shutter 3, for example using the brackets 1 and 9, as mentioned in FIG. 4, and is therefore forced to translate along the track 6, until one of its hooks 48 or 58 encounters one of the strikers 80-80' placed at the beginning and end of the travel section for the translation of the shutter itself 3, for the opening or closing of the void 8, determining the beginning or the end of the section for cushioning this travel.

From the above, it can be inferred that, at the stage of applying the cushioning device 20 to the shutter 3, the hooking to the corresponding strikers 80 and 80' is not automatic, given that the tension, even above the limits, of the elastic device 60 never allows the hooks 48, 58 to encounter said strikers 80, 80'.

In order to overcome this aspect and to guarantee the maximum operating safety of the device in question, a first safety hook 90 is applied to one of the sliders 40 and a second safety hook 100 is applied to the other slider 50.

With reference to FIG. 7, the hook 90 is pivoted with a hinge 91 to the hole 48*b* of the hook 48 and has a hooked part 90*a* with an external slide or raiser 90*b*. A different hinge 92 is housed in a slot 90*c* of the safety hook 90, presenting an opposite end 92*a* that can slide along a slot 93*a* made on the bottom of a guide block 93, and wound around by an elastic spiral 94, with an arm 94*a* striking against a cylindrical part 90*d* of the safety hook 90. Especially, the hinge 91 extends through the cylindrical part 90*d* of the safety hook 90. The hinges 91, 92 extend in a vertical direction having their axes in parallel and distanced one to the other.

Similarly and with reference to FIG. 8, the other safety hook 100 is pivoted with a hinge 101 to the hole 58*b* of the other hook 58 and has a hooked part 100*a* with an external slide or raiser 100*b*, whilst a different hinge 102 is housed in a slot 100*c* of the safety hook 100, presenting an opposite end 102*a* that can slide along a slot 103*a* made on the bottom of a guide block 103, wound around by an elastic spiral 104 with an arm 104*a* striking against a cylindrical part 100*d* of the latter safety hook 100.

Said safety hooks 90 and 100 are forced to slide, together with their guide blocks 93, 103 and together with the ordinary hooks 48, 58, along the lower slit 24 of the box 20, as highlighted in FIG. 10.

The same FIG. 10 shows that with the translation of the box 20, following the translation of the shutter 3 to which it is integrally fixed for example by means of the bracket 1, the hooks 48 and 58, are freed from the striker 80, 80' that remains fixed, but are pushed by these to rotate on their hinge 47, 57, translating in their housings 48*d*, 58*d* and being brought to be housed in voids formed by the lateral slots 25 and 26 at the ends of the lower open slit 24 of the box 20.

When these hooks 48, 58 are housed in said corresponding slots 25, 26 the elastic device 60 remains under tension but cannot unblock them, until the same hooks 48, 58, are forced to rotate on their hinge 47, 57, due to their fork housing 48*d*, 58*d* newly encountering a striker 80 or 80', along the path for the manual drawing of the travelling shutter 3.

When hook 48 or 58 is freed at the blocking position in the recesses 25, 26 of the slit 24, the elastic device 60 reacts and tends to rapidly bring the corresponding slider 40 or 50 back to the centre of the void 22, until it possibly encounters the striker 28 of the box 20. Opposing this reaction of the elastic device 60 are the braking devices 70' and 70", present on the sliders 40 and 50, thus achieving, with a single device formed by the box 20, the desired cushioning of the final travel for the opening and closing of the shutter 3 on the void 8, in accordance with the main aim proposed.

The presence of the crooks 48*c* and 58*c* of the hooks 48 and 58, respectively, enables a second simultaneous or alternative form of blocking of the same hooks 48, 58 in their maximum opening position as in FIG. 9. In fact, with the rotation of these hooks 48, 58, caused by their forks 48*d*, 58*d* passing onto the fixed strikers 80, 80', together with their housing in the voids 25 and 26 of the box 20, there is also a hooking of their crooks 48*c*, 58*c* to the ends of the small side wall 33 of the cover 30, whilst their freeing is ensured by the rotation of the same hooks 48, 58, due to a subsequent passage of their fork housings 48*d*, 58*d* onto the fixed strikers 80, 80'.

As mentioned above, during initial installation or when forcibly removing the shutter 3, the hooking of the forks 48*d*, 58*d* to one or both fixed strikers 80, 80' is not automatic, which is why the safety hooks 90 and 100 are provided, as already described.

During the translation of the shutter 3 towards the opening and closing ends of the void 8, the inclined or raised ends formed by the raisers 90*b* and 100*b* of the safety hooks 90-100, respectively, encounter the strikers 80, 80' and are forced to lift, rotating on their hinge 90*d*, 100*d*, with a rotation regulated by pegs formed by the other hinges 92, 102 of the safety hooks 90, 100 within the slits or slots 93*a*, 103*a* of the corresponding guide blocks 93, 103, as can be seen from FIG. 10.

Their rotation is also regulated by the springs 94, 104 for which, having overcome the obstacle of the fixed strikers 80, 80', the springs cause the same safety hooks 90, 100 to lower and bring the same strikers 80, 80' to be housed in their crook 90*a*, 100*a*, drawing them, together with their sliders 40, 50 and their corresponding hooks 48, 58, along the lower slit 24, until the same hooks 48, 58 encounter a new striker 80, 80' onto which to hook, for the normal activation of the cushioning phase already illustrated above.

Having thus described the main parts making up the present innovative device for cushioning the final movement of a shutter 3, when opening and closing a void 8, as well as of the accessory parts to which the same device can be applied, the operation is summarised below, particularly with the aid of FIGS. 11 to 16 on which, for simplicity of graphical representation, the tracks 6, 6' and the other parts that can be identified by FIGS. 3 and 4 have not been shown.

Figure 11:
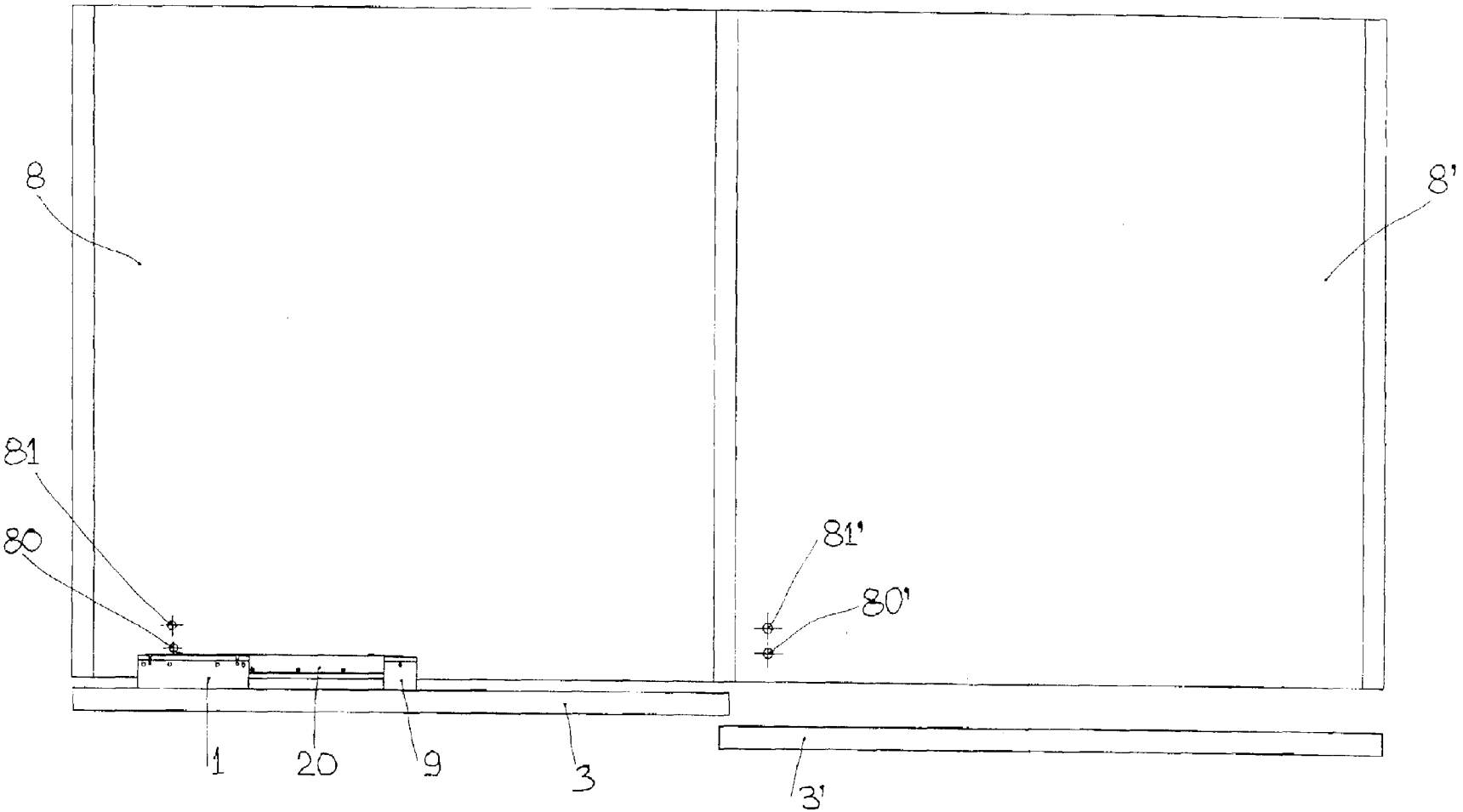
FIG. 11 shows a plan view of an item of furniture with two voids, with both shutters enclosing the corresponding void, highlighting the position of the cushioning box in FIG. 5 applied to one of the two shutters.
Figure 12:
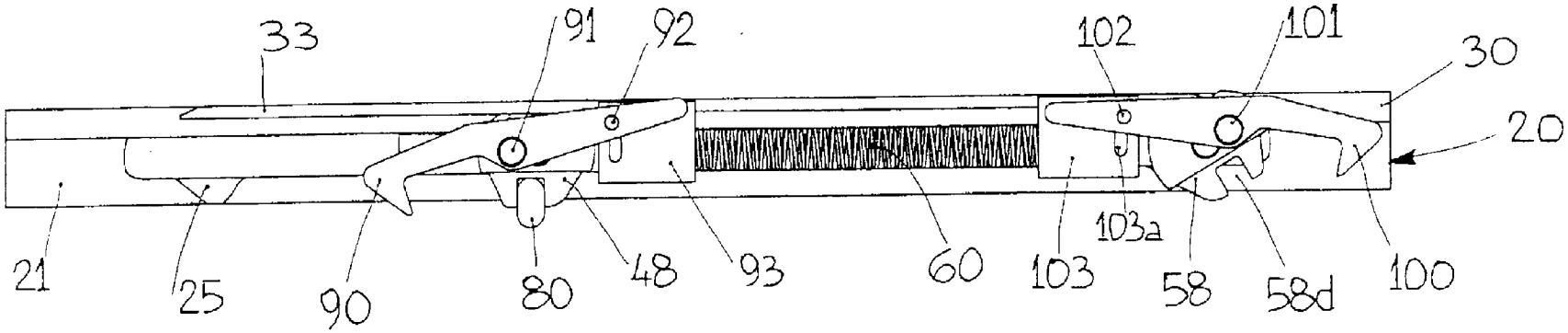
FIG. 12 shows a magnified plan view of the operating condition of the cushioning box in FIG. 11.
Figure 13:
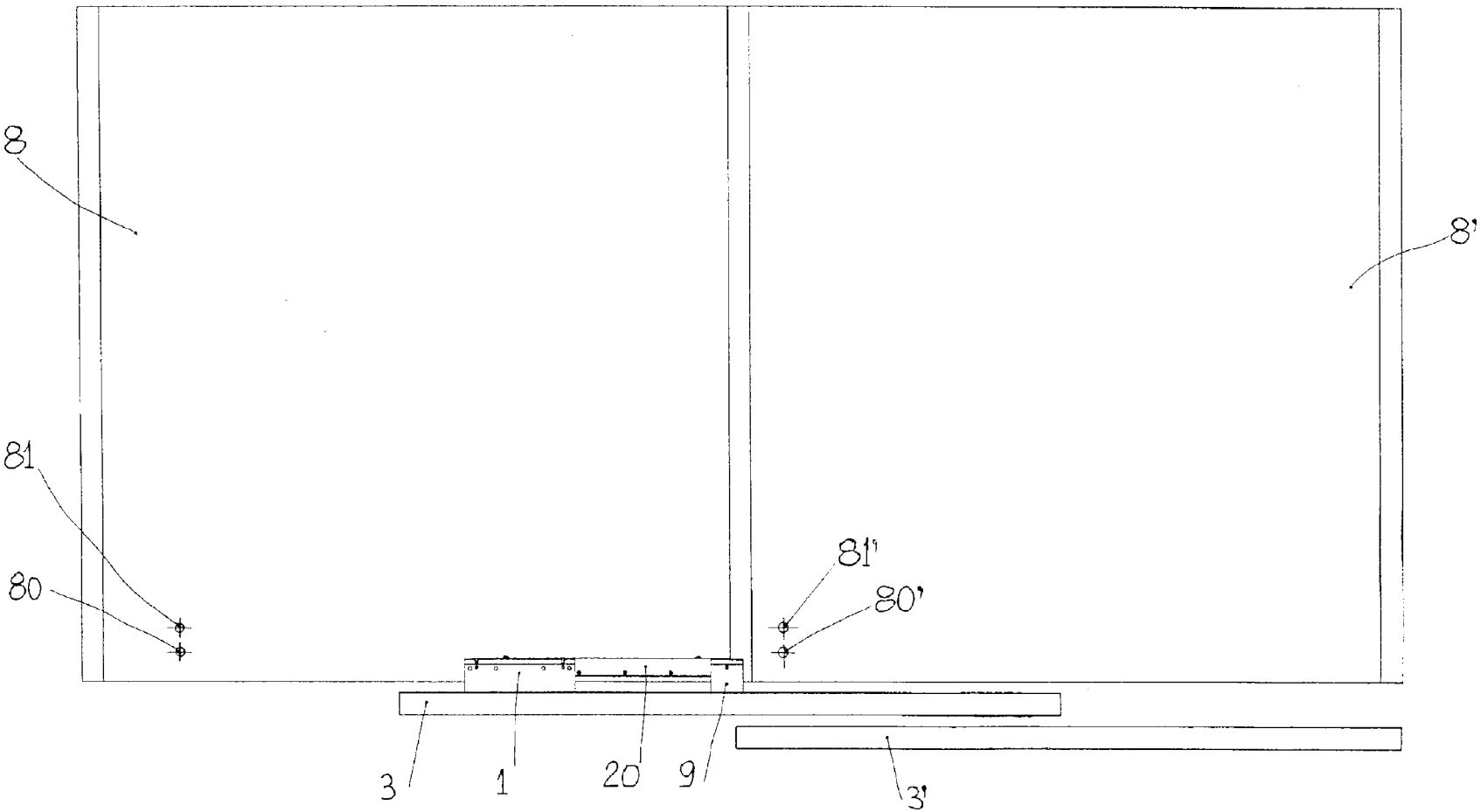
FIG. 13 shows a plan view corresponding to the view in FIG. 11, but with one shutter in its manual translation phase, having overcome the initial cushioning phase and before the final cushioning, for the full opening of its void.
Figure 14:
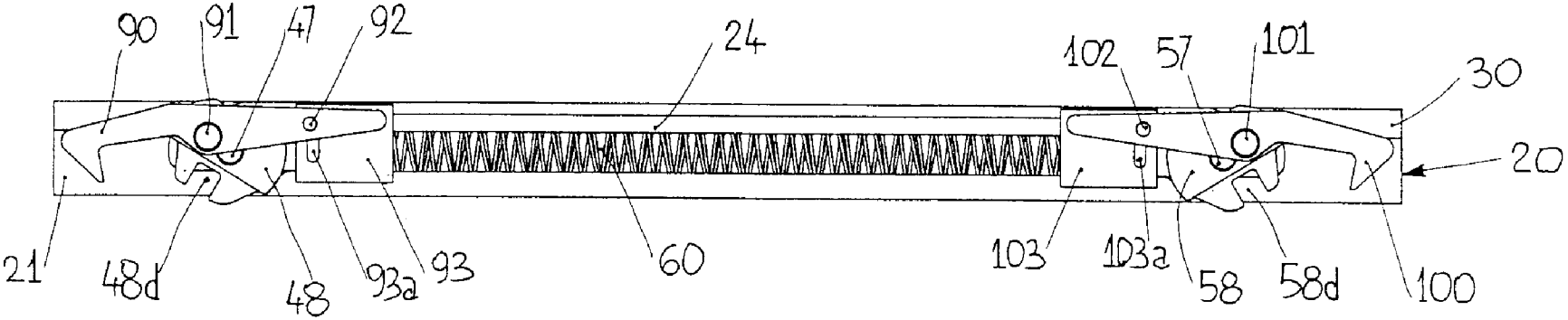
FIG. 14 shows a magnified plan view of the operating condition of the cushioning box in FIG. 13.

FIGS. 11 and 12 highlight the position and the condition of the box 20 attached to the shutter 3, when the shutter itself 3 is in a normal closing position on the void 8, just as the shutter 3' is normally closed on the void 8'. In this closing position, the first hook 48 is stopped by the striker 80 that determines the stability of this condition, whilst the second hook 58 is still housed and blocked in the housing formed of the recessed lateral slot 26 of the lower slit 24, with the elastic device 60 in a position of minimum traction on the hook 48. Starting the manual pushing of the shutter 3, to open the void 8, the box 20 also advances with the shutter 3, to which it is fixed by the brackets 1 and 9, with a consequent increase in the traction of the elastic device 60 on the first slider 40 and on its hook 48, whilst the braking action of the device 70', which is incorporated into the same slider 40, slows down and delays the unhooking of the slider 40 from the striker 80.

The high elasticity of the springs 61 and 64 whose sum of action allows for a uniform distribution of the reaction to the manual pushing of the shutter 3, relates to the prescribed braking force of the braking devices 70' and 70", so as to determine the correct longitudinal position of the strikers 80 and 80' along the tracks 6 for the idler wheels 4 and 5 for the translation of the shutter 3. The strikers 80, 80' are positioned in striker tracks being arranged in parallel to the tracks 6, 6' on the upper side of the base plate 12.

FIGS. 11-13 and 15, together with strikers 80, 80', also show strikers 81, 81' and must be understood to be either side of the track 6', for the cushioned translation of the shutter 3', which is supported by different brackets 1', 2' and has another identical cushioning box 20' which it was not deemed necessary to show.

Continuing the manual traction of the shutter 3 and also the braking action of the braking device 70' of the first slider 40, the hook 48 remains engaged with the striker 80 until the advancement of the box 20 brings the housing formed by the corresponding lateral slot 25 in line with the same hook 48 which remains housed in it, and, rotating on its hinge 47, frees itself of said striker 80. In this situation, the initial cushioning action on the opening shutter 3 stops, whilst the manual pushing action continues, towards the full opening of the void 8, with the hook 48 housed in the void formed by the first lateral slot 25 and the other hook 58 housed in the opposite void formed by the other, second lateral slot 26, at the two ends of the lower slit 24 and therefore with the elastic device 60 constantly tense, as shown in FIG. 10 and in FIGS. 13 and 14.

Figure 15:
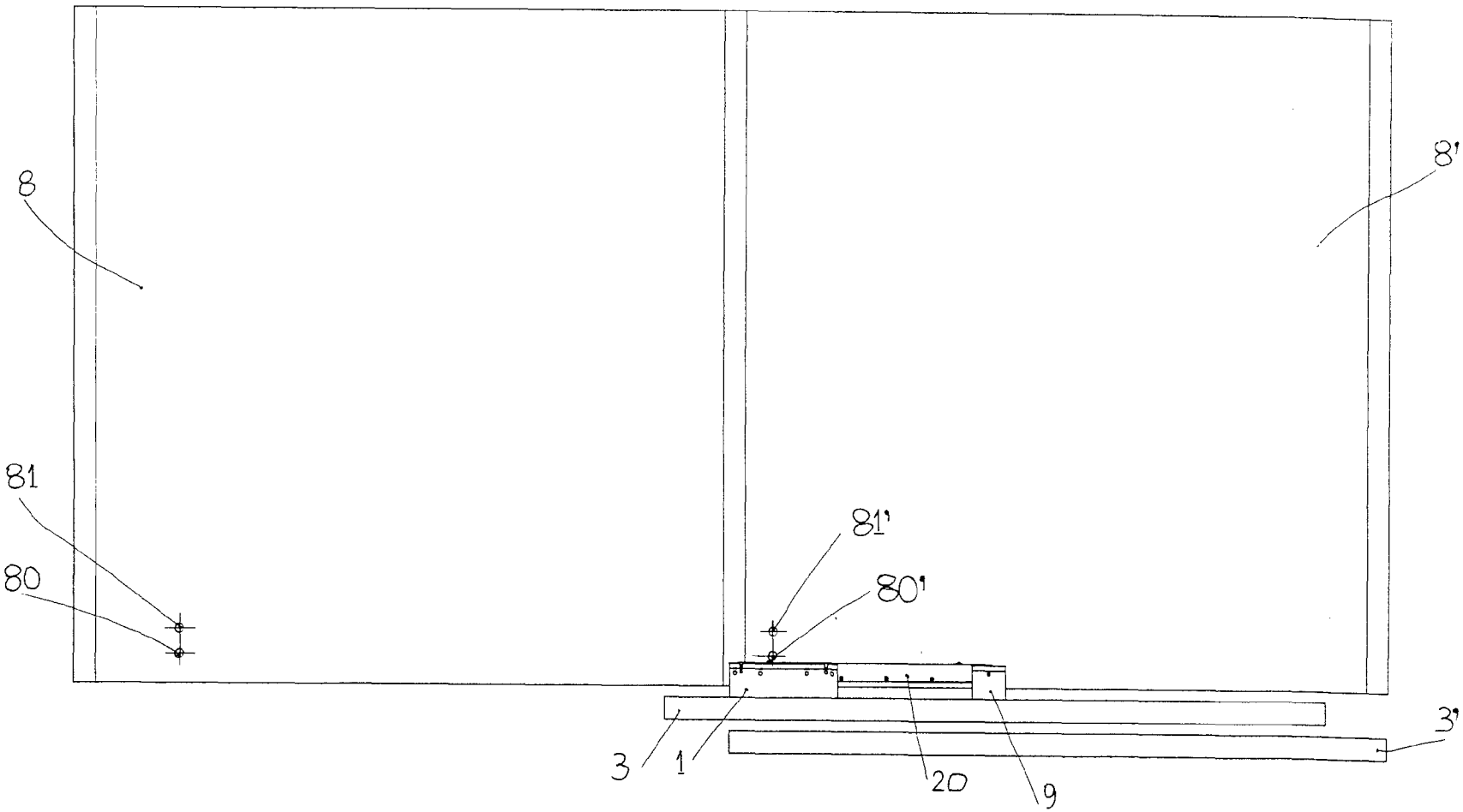
FIG. 15 shows a plan view of the same item of furniture in FIG. 11, with one shutter in its final cushioned opening stage, highlighting the position of its cushioning box as per FIGS. 4 and 5.
Figure 16:
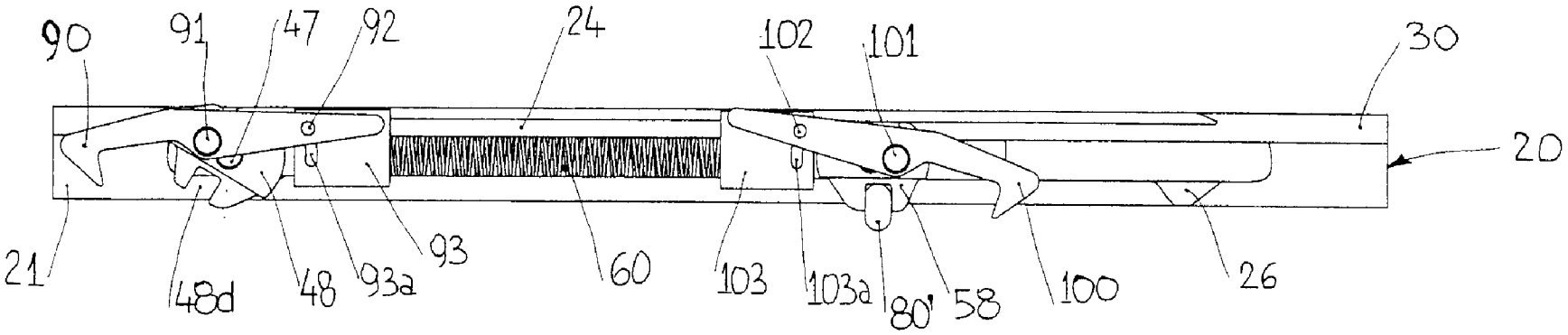
FIG. 16 shows a magnified plan view of the condition of the cushioning box as per FIG. 15.

FIGS. 15 and 16, highlight the fact that, continuing along the direction that opens the shutter 3 and its cushioning box 20, the other hook 58 encounters the other striker 80' and embeds itself with its housing 58*d*, lifting up from the recess or housing 26 and starting the final cushioning phase, in view of the arrival of the shutter 3 in its full opening position on the void 8.

In fact, the braking device 70", integral to the slider 50 and to the other, second hook 58, brakes the reaction of the elastic device 60 and of any residual manual thrust acting on the shutter 3, slowing and regulating its final travel, until the other striker 80' encounters the first hook 48 and remains entrapped, within its housing 48*d*, to ensure the stability of the condition of full opening of the void 8. Naturally, when closing the void 8 again, it is sufficient to appropriately draw the shutter 3, in order to unblock the first hook 48 from the other striker 80', inverting the phases described so far in order to allow the desired cushioning action when closing the same void 8.

From all this, it is clear that, with a single cushioning box, it is possible to regulate the travel of a shutter, when both opening and closing a void, in accordance with the main aim proposed.

The hooking of the two high elasticity spiraled springs 61 and 64 enables the elastic device 60 to react uniformly to the action of the braking devices 70' and 70", without having to apply boxes that are excessively long or that have blocking devices that distribute their force, consistent with yet another of the specific aims.

The cushioning box 20, complete with its attachments described above, can be joined to one of the brackets 1, 2 of each type that must be applied for the shutter 3 to slide, or else it can be applied to each type of bracket, as well as to any of its own brackets 9, making itself in fact universal and applicable to any sliding shutters, consistent with yet another of the specific aims.

The same cushioning box 20 also eliminates all the problems of extraordinary or scheduled maintenance due to the use of piston cushioning, consistent with yet another of the specific aims.

Naturally, the structural solution described so far for illustration purposes, can also be designed in other structural forms, initially with the possibility of associating three or four shutters, adequately extending the tracks 6, 6' and equipping them with further strikers 80, 81, suitably mounted on the upper surface 7 or on the base plate 12, just as the same improved device 20 can be used for a plurality of shutters or movable walls, again with the possibility of being applied as a single item for cushioning the final travel for opening and closing each mobile shutter or wall.

Similarly, it is possible to replace the pair of spiraled springs 61, 64 with another elastic device 60 capable of having a corresponding effect on the uniformity and constancy of the reaction to the braking action of the braking devices 70' and 70", just as it is possible to invert the layout of the box 20, by adjusting the position of the strikers 80, 80' and 81, 81'.

As already mentioned, it is also possible to ensure the blocking of the hooks 48 and 58 acting only on the lateral slots 25 and housings 26 of the lower open slit 24, just as it is possible to ensure the same blocking just by hooking the crooks 48*c*, 58*c* to the ends of the small side wall 33 of the cover 30 or of a corresponding wall of the base of the box 21, just as the strikers 80, 80' and/or 81, 81' can be variously arranged on the upper surface 7 of the void 8, 8' to be opened or closed.

These and other corresponding amendments or adjustments are understood in any case to be part of the originality of the subject matter being protected.

The invention claimed is:

1. A cushioning device to cushion opening and closing movement of sliding shutters for furniture, comprising:

strikers adapted to be mounted on shutter sliding tracks;

a cushioning box applied with brackets or on brackets for the support and sliding of a shutter and having opposing braking devices, each braking device including a toothed hub that directly meshes with a rack fixed to the box and being joined to a slider guided by the box, each slider being attached at one end by an elastic device and being equipped with a hook to activate and deactivate the corresponding action of the final section of travel to be cushioned due to contact of the hooks with the strikers; wherein one end of the elastic device is attached at one end of the sliders and an opposite end of the elastic device is attached at the other slider.

2. The cushioning device as per claim 1, wherein the cushioning box comprises a structured box base with a longitudinal lower slit on the lower side and a flank closed by an edge or guiding wall of a cover, the lower slit being disposed between an internal cushioning part, which includes said elastic device, and an external activation part, which includes said hooks for hooking and unhooking, vis-à-vis strikers mounted near tracks for translation of one or more of the shutters.

3. The cushioning device as per claim 2, wherein the structured box or base has a longitudinal void to contain and guide the longitudinal translation of said sliders in cooperation with the cover that delimits the longitudinal void of the structured box base.

4. The cushioning device as per claim 2, wherein each braking device comprises a viscous fluid rotary type with toothed pinions that directly mesh with teeth of said rack joined longitudinally to the box.

5. The cushioning device as per claim 4, wherein the rack is integral to the cover.

6. The cushioning device as per claim 2, wherein the lower slit of the structured box base has a pair of lateral slots and/or housings mounted near its ends for housing said hooks.

7. The cushioning device as per claim 6, wherein during the external or manual opening or closing of such a shutter the hooks can be housed in their corresponding slots or housings of the lower slit, remaining engaged there until a new contact with the same strikers, acting on their contact housings makes them rotate on a respective hinge, thereby, releasing them from their slot or housing, together with their corresponding sliders, causing the desired cushioning, with the traction reaction of the elastic device and the braking reaction of the braking devices.

8. The cushioning device as per claim 2, wherein the cover has a small side wall or edge being shorter than the length of the lower slit of the structured box base.

9. The cushioning device as per claim 2, wherein following the external or manual opening or closing of a shutter, crooks of the hooks hook onto the ends of a small side wall of the cover, and remain engaged there until a new contact with the same strikers, acting on their contact housings makes them rotate on a respective hinge, thereby, releasing said crooks at the ends of the small side wall, together with their corresponding slider, causing the desired cushioning, with the traction reaction of the elastic device and the braking reaction of the corresponding devices.

10. The cushioning device as per claim 1, wherein the sliders are joined together by the elastic device working by traction, used to bring the same sliders closer together, thereby overcoming the braking force of the braking device.

11. The cushioning device as per claim 10, wherein the elastic device is made up of a double helical traction spring made out of an elastic material, one of the springs being equipped with head hooks or eyelets and the other spring being an internal and coaxial spring and being equipped with head hooks or eyelets that can hook onto the two sliders.

12. The cushioning device as per claim 1, wherein the sliders are linked to their corresponding hooks, which are external to the box and can activate a traction action of the elastic device as well as the braking action of the braking devices due to the contact of these hooks with said strikers mounted in a suitable position, near tracks for the sliding and translation of the shutters.

13. The cushioning device as per claim 1, wherein a safety hook is joined to each of said hooks, the safety hooks being equipped with a hooked wall adjoining an inclined wall that hook the strikers in an initial stage of the application of the device or in subsequent ones when it is newly applied to the sliding shutters.

14. The cushioning device, as per claim 1, wherein the cushioning box is adapted to be arranged in a position of the upper side of the shutter and the position of the strikers is adapted to be adjusted correspondingly along the track.

15. The cushioning device of claim 1, wherein the cushioning box comprises brackets for fixing the box to the shutter.

16. The cushioning device of claim 1, further comprising:

brackets attached to the cushioning box, for supportably fix the box to the shutter.

* * * * *